United States Patent [19]

Cabillo

[11] 4,146,098

[45] Mar. 27, 1979

[54] MASONRY CUTTING TOOL

[76] Inventor: John S. Cabillo, 105 E. Lola Dr., Austin, Tex. 78753

[21] Appl. No.: 756,995

[22] Filed: Jan. 5, 1977

[51] Int. Cl.[2] ..... E21B 1/06

[52] U.S. Cl. ..... 173/104; 175/105

[58] Field of Search ..... 175/135, 405, 414; 173/104; 76/101 R

[56] References Cited

U.S. PATENT DOCUMENTS

| | | | |
|---|---|---|---|
| 739,608 | 9/1903 | Kotten | 173/104 |
| 1,160,829 | 3/1915 | Blumenthal | 175/405 |
| 2,285,702 | 6/1942 | Forss | 173/104 |
| 2,929,361 | 3/1960 | Reynolds et al. | 173/104 |

FOREIGN PATENT DOCUMENTS

| | | | |
|---|---|---|---|
| 712030 | 6/1965 | Canada | 175/405 |

*Primary Examiner*—James A. Leppink

[57] ABSTRACT

Masonry cutting tool used in conjunction with a pneumatic mechanism, e.g., air-operated hammer, comprising a drill head, a plurality of cutting prongs provided on the drill head, the drill head connected to a hammer shank, and a handle removably joined to said hammer shank for rotation of the drill head during the cutting operation.

6 Claims, 3 Drawing Figures

MASONRY CUTTING TOOL

BACKGROUND OF THE INVENTION

1. Field of the Invention

This invention relates to a pneumatically operable cutting tool for mason work.

2. Description of the Prior Art

There are of course various cutting tools available for use by masons and sculptors for cutting, drilling, or shaping marble, concrete, brick and other stonework. Many of these are pneumatically operable as well. However, those in the prior art are usually provided with a plurality of removable drill bits, are cumbersome and heavy and by their nature require the cutting of a relatively large area with relation to the actual work to be done. Some of these cutting tools may be found in U.S. Pat. Nos. 823,584; 1,031,870; 1,115,024; 1,252,082; and 1,476,120.

SUMMARY OF THE INVENTION

It is, therefore, among one of the principal objectives of this invention to provide a pneumatically operated masonry cutting tool which will cut only the actual dimensions required reducing waste and providing more precise work, which is light in weight, and which is faster cutting, all of which reduce operator fatigue.

In accord with the present invention there is now provided a masonry cutting tool, pneumatically operable, in this case by an air hammer, comprising a drill head, a plurality of cutting prongs on said drill head, said drill head mounted to a hammer shank connectible to a pneumatic source, and a handle removably joined to said hammer shank for rotation of said drill during the cutting operation.

BRIEF DESCRIPTION OF THE DRAWING

The invention will be hereinafter more fully described with reference to the accompanying drawing in which.

DESCRIPTION OF THE PREFERRED EMBODIMENTS

Figure 1:
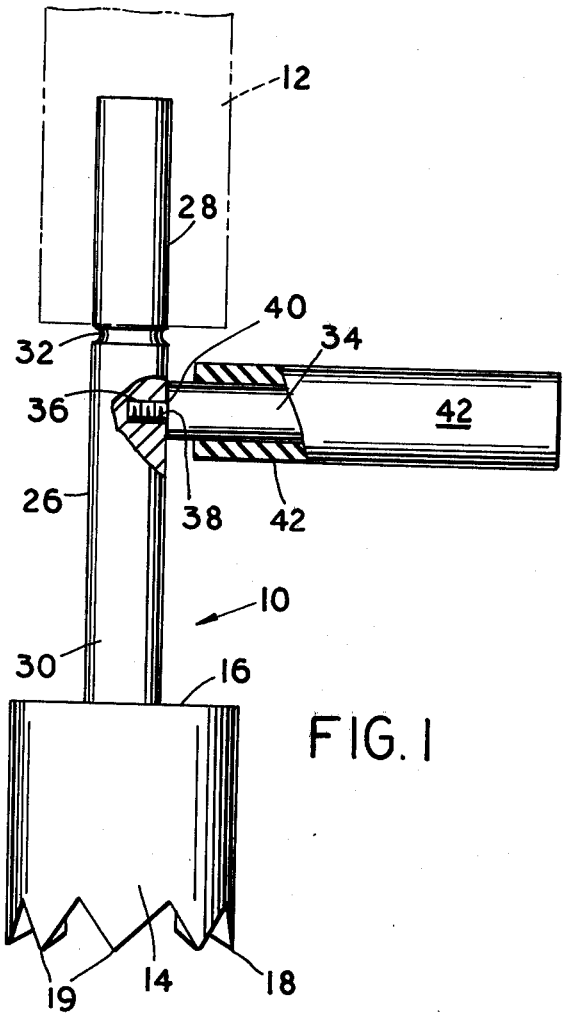
FIG. 1 is an elevated view of the invention cutting tool partially in section and with a pneumatic source, e.g., air hammer, shown connected thereto in phantom.
Figure 2:
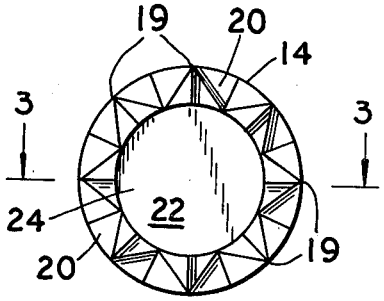
FIG. 2 is a bottom plan view of the drill head.
Figure 3:
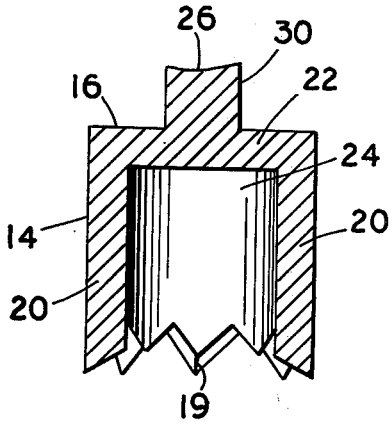
FIG. 3 is a sectional view taken along line 3—3 of FIG. 2 in the direction of the arrows.

Referring now to the figures of the drawing there is shown therein the invention masonry cutting tool or "air drill bit" 10 (hereinafter referred to as "cutting tool") connectible to a conventional pneumatic driving source 12, e.g., an air hammer, shown only in phantom. Cutting tool 10 is formed of a suitable metal such as tool steel, or the like.

The cutting tool 10, or "air drill bit," as it were, comprises a short cylindrical drill head 14 closed at its upper end 16 and open at its cutting or leading end 18. The side and bottom inside walls 20 and 22, respectively, define, in turn, a cylindrical chamber 24 whose function is to receive the material drilled or cut. The cutting end 18 of the drill head 14 is provided with a plurality of cutting prongs 19. In this preferred embodiment there are light triangular shaped cutting prongs 19 having a cutting angle of 60° from the vertical, and having an apex angle between them of 60°.

Mounted to, such as by welding, and extending vertically from, the upper end 16 of the drill head 14 in a generally central location, is a solid cylindrical elongated hammer shank 26. Hammer shank 26 is adapted at its upper end 28 to be connectible to an air operated hammer 12, shown only in phantom. The air hammer is conventionally known and need not further be described since the invention does not reside therein.

Upper shank end 28 is of a slightly smaller diameter than the main body 30 of hammer shank 26, hence, the tapered ridge 32 therebetween.

Extending outwardly from and at right angles to, shank 26 there is provided a short solid cylindrical handle 34. Handle 34 is provided with a threaded pin 36 which is threadingly engageable with associated threads 38 provided in an opening 40 in the main shank body 30. Thus, the handle is removable which makes for easy storage of the "air drill bit." A rubber grip 42 is provided around the handle 34 for better gripping.

Describing now the operation of the invention cutting tool 10, the upper shank end 28 is connected to the air hammer 12 and holding the handle 34 with one hand and positioning the tool with the other, in the location to be drilled or cut in the workpiece, the air hammer is triggered. The drill head 14 is rotated back and forth via the handle 34 while the prongs 19 are cutting through the stone. The prongs on the drill head will cut only the actual circumference of the hole to be drilled. This will be determined by the outside diameter of the drill head chosen. Obviously, the drill heads will come in numerous sizes. Since the drill head cuts only that which is supposed to be cut, the area to be cut is reduced which has been a problem in the prior art. The present device is also light in weight and faster cutting all of which advantages result in less fatigue to the operator. The present device can drill such materials as hard concrete or hard brick. Indeed, it can cut a hole through a four inch wall.

What is claimed is:

1. A pneumatically operable masonry cutting tool which comprises a drill head, a plurality of cutting prongs on said drill head, said drill head and prongs positionable against a masonry workpiece, said drill head counted to a shank member, the top portion of said shank being tapered and said drill head having a larger diameter than said shank member, said shank member connectible to pneumatic drive means, and a handle removably joined to said shank member for rotation of said drill head during activation of said pneumatic driving means and resulting cutting of said masonry workpiece.

2. A cutting tool according to claim 1 wherein said drill head is cylindrically shaped and is closed at one end and open at the other end, the inside walls of said drill head resultingly defining a cylindrical chamber, said open other end of said drill head being provided with said plurality of cutting prongs.

3. A cutting tool according to claim 2 wherein said cutting prongs are eight in number.

4. A cutting tool according to claim 2 wherein said shank member further comprises a hammer shank, said hammer shank being formed of an upper shank end and a main shank body, said upper shank end being connectible to said pneumatic driving means, said hammer shank being mounted to said drill head at the end of said main shank body and extending vertically axially therefrom.

5. A cutting tool according to claim 4 wherein said handle is a cylindrically shaped solid body, said body being provided with a threaded pin, said main shank body being provided with associated threaded opening means, said threaded pin being threadingly removably engageable in said opening means and said handle extending horizontally axially from said main shank body as a result of said threading engagement.

6. A cutting tool according to claim 5 wherein said handle is covered with a friction-resistant material.

* * * * *